United States Patent [19]

Wood

[11] Patent Number: 4,702,942

[45] Date of Patent: Oct. 27, 1987

[54] DECO-PLEX PROCESS

[76] Inventor: Timothy J. Wood, 340 Laurel St., East Haven, Conn. 06512

[21] Appl. No.: 835,766

[22] Filed: Mar. 3, 1986

Related U.S. Application Data

[63] Continuation-in-part of Ser. No. 707,132, Mar. 1, 1985, abandoned.

[51] Int. Cl.[4] ..... B05D 1/32

[52] U.S. Cl. ..... 427/259; 427/282; 428/195; 428/203

[58] Field of Search ..... 428/195, 203; 427/259, 427/272, 282, 421

[56] References Cited

U.S. PATENT DOCUMENTS 2,456,376 12/1948 Chirelstein ..... 427/282
3,810,812 5/1974 Koenig ..... 427/282
4,217,378 8/1980 Pizur ..... 427/259

FOREIGN PATENT DOCUMENTS 2465693 3/1981 France ..... 427/282

*Primary Examiner*—Shrive P. Beck
*Attorney, Agent, or Firm*—Chilton, Alix & Van Kirk

[57] ABSTRACT

A process for the preparation of works of art comprises removing portions of a protective cover paper from a first surface of a clear plexiglass panel, spray painting the thus exposed surface areas of the panel while the remaining protective paper functions as a mask, repeating the steps of partial removal of the protective paper and paintaing until a completed design has been formed on the rear surface of the panel and then peeling the protective cover paper from the front surface of the plexiglass panel to permit viewing of the work of art.

4 Claims, 5 Drawing Figures

DECO-PLEX PROCESS

CROSS-REFERENCE TO RELATED APPLICATION

This application is a continuation-in-part of application Ser. No. 707,132, filed Mar. 1, 1985, now abandoned.

BACKGROUND OF THE INVENTION (1) Field of the Invention

This invention relates generally to fine art painting and particularly to a process for the preparation of works of art. More specifically, this invention is directed to works of art and particularly to paintings which include a transparent substrate. Accordingly, the general objects of the present invention are to provide novel and improved methods and articles of such character.

(2) Description of the Prior Art

The art of painting upon transparent plates of glass or clear plexiglass sheets has been practiced for a considerable period time. In the past, however, the techniques employed for painting upon such transparent substrates have been difficult to master, particularly by amateurs, and have not resulted in distinctive works of art formed by combining masked and painted portions.

SUMMARY OF THE INVENTION

The present invention comprises a novel and improved technique for producing works of art on a transparent substrate, such as a plexiglass panel, and works of art resulting from the practice of this novel process. In accordance with the present invention, a transparent substrate in sheet or panel form is partly masked and a remaining portion or portions is then painted so that, when viewed from the opposite side of the substrate, the lines of demarkation between the masked and painted portions are very clear and distinct. Subsequently, the masking is partially or completely removed and the surface areas of the substrate thereby exposed will be painted, this second area to be painted comprising, for example, a background to the initially painted portion(s). The practice of the invention may, of course, comprise a plurality of serially performed alternate steps of removing a mask portion followed by painting the surface of the substrate thus exposed.

It is, accordingly, an object of the present invention to provide a novel and improved process for decorating a flat, substantially transparent substrate.

Another object of the present invention is to provide a process which produces a new art form comprising distinctive designs which are viewed through a substantially transparent substrate.

Yet another object of the present invention is to provide a process for the production of works of art which is easy to employ and which may be produced from comparatively inexpensive materials sold in kit form.

BRIEF DESCRIPTION OF THE DRAWING

The above-described and other objects and advantages of the present invention will become apparent to those skilled in the art by reference to the accompanying drawing wherein.

DESCRIPTION OF THE DISCLOSED EMBODIMENT

Figure 1:
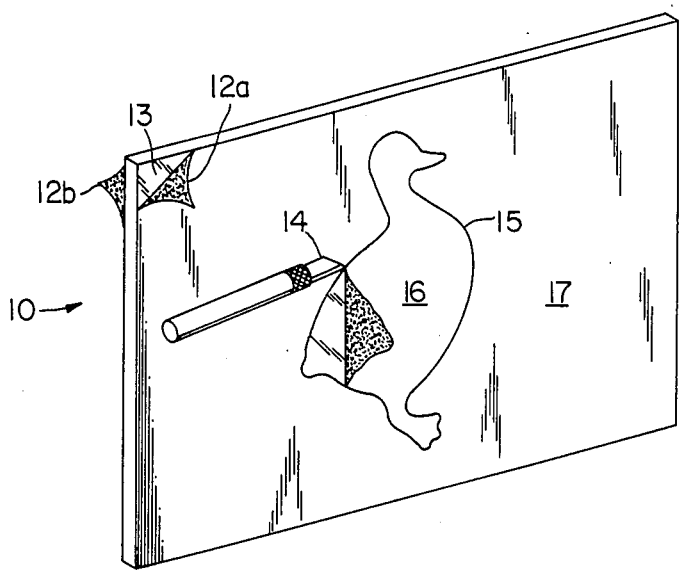
FIG. 1 is a perspective view which depicts an initial step performed in the practice of the present invention.

With reference now to the drawing, a substrate which will be employed in the practice of the invention is indicated generally at 10. Substrate 10 will be employed in the production of the work of art indicated generally at 11 in FIG. 5. In accordance with the invention, the substrate 10 will be transparent and will typically comprise a sheet of clear plexiglass. Such sheets of clear plexiglass are commercially available from art supply dealers and, as sold, are provided with a sheet of protective paper adhesively secured to each side. In the context of the work of art to be prepared, the sheet of protective paper on the rear side of transparent plexiglass substrate 10 is indicated at **12*a* while the sheet of protective paper on the front side of substrate 10 is indicated at 12*b*. The sheets of protective paper 12*a* and 12*b* are provided with an adhesive of a character which permits the protective paper to be separated from the substrate with minimal adhesive residue remaining on the substrate. The sheets of paper 12*a* and 12*b*** protect the relatively soft surfaces of the plexiglass panel from becoming scratched prior to use.

In the practice of the present invention, the artist will draw the mirror image of the artwork he wishes to create on the protective paper **12*a* which covers the rear side of the transparent substrate 10. At this time the protective paper 12*b* remains on the front side of panel 10. After the design has been drawn, the artist will employ a cutting instrument 14 to cut along an outline 15 of a portion of the drawing. In actual practice, each cutting step may involve tracing with the cutting instrument along continuous lines, i.e., lines that close on themselves, which define several discrete areas. When the first cutting step has been completed, thus isolating a portion 16 or several portions 16 of protective paper 12*a* from the remainder thereof, the portion or portions 16 are peeled away from the substrate. The remaining portion or portions of protective paper 12*a* which are left adhering to the plexiglass panel 10** thus serve as a mask for the next step in the process.

Figure 2:
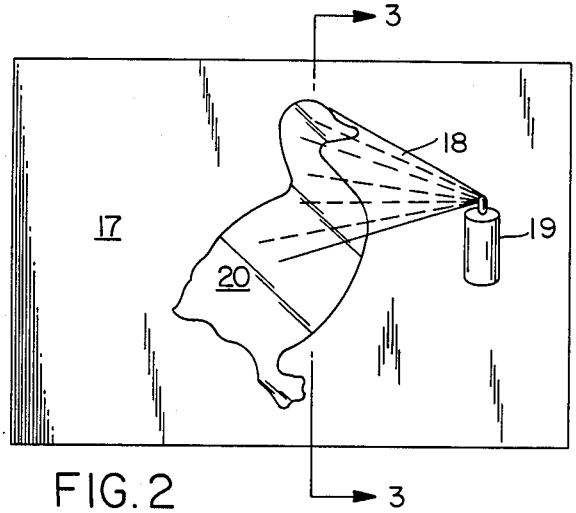
FIG. 2 is an elevation view depicting the step in the practice of the present invention performed immediately subsequent to practice of the step of FIG. 1.
Figure 3:
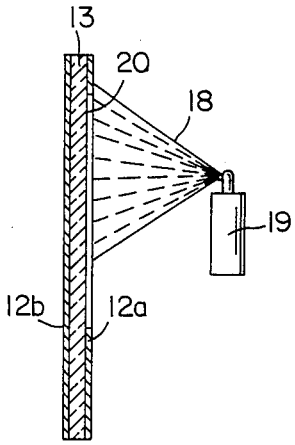
FIG. 3 is a view taken along line 3—3 of FIG. 2 depicting the performance of the step of FIG. 2.

The next step, as represented by FIGS. 2 and 3, comprises the painting of the surface area or areas of the rear side 20 of panel 10 which were exposed by the removal of the portion(s) 16 of the protective paper **12*a*. Typically, this painting is done by spraying an acrylic enamel paint 18 from a pressurized container 19, the paint thus coating the exposed portions of the rear side 20 of panel 10**.

The steps described above are repeated in sequence until each portion of side 20 of panel 10 which is to form a painted portion of the work of art has been painted. As will be obvious to those skilled in the art, those areas which are to be painted with the same color will typically all be spray painted at the same time. In the typical case, the series of sequentially performed cutting, peeling and painting steps will be repeated until all of the protective paper 12*a* has been removed from the rear side of panel 10.

Figure 4:
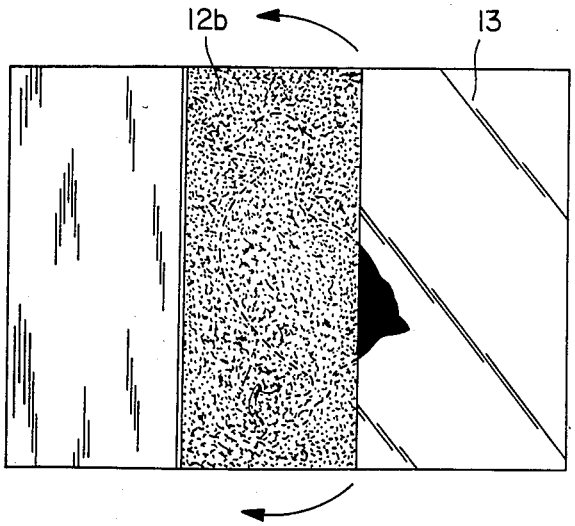
FIG. 4 is an elevation view taken from the side opposite to that of FIG. 2, which represents another step performed in the practice of the present invention.
Figure 5:
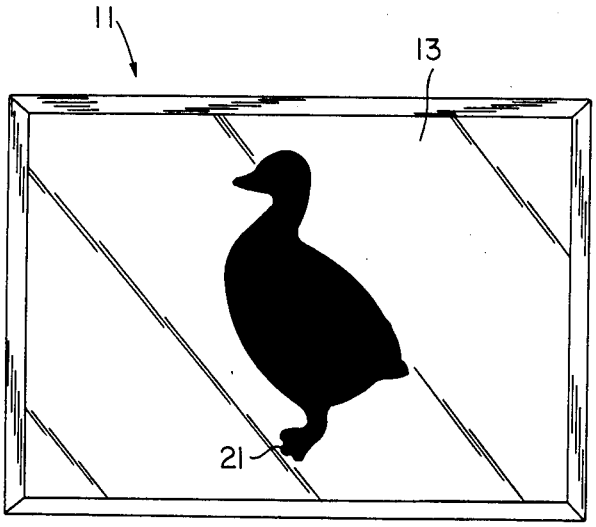
FIG. 5 is a view of a completed work of art, albeit an oversimplified example, produced in accordance with the practice of the present invention.

The next step in the practice of the present invention is to peel the protective paper sheet 12*b* from the front side of panel 10, this step being illustrated partially completed in FIG. 4. When protective paper 12*b* is completely removed, the finished work of art may be viewed through the transparent panel 10. The panel may then be framed, as represented in FIG. 5, and will constitute completed work of art which has a highly distinctive appearance. It will be recognized that FIG. 5 is an oversimplified view and that in actual practice the duck shown in the drawing would be presented along with an appropriate background.

One of the unique features of the present invention resides in the fact that the outline(s) of the painted areas, for example the outline 21 of the duck, are sharply defined when the above-described method is employed. These sharply defined edges result regardless of whether the paint is applyed by means of an aerosol can, air brush or conventional bristle brush.

Another feature of the present invention is the ability to actually paint a mat or border on the transparent substrate 10 around the actual design, i.e., the artwork and mat may be unitary and thus only the transparent substrate need be framed. The framing may be accomplished through the use of an aluminum channel frame of a commercially available type which accommodates a one-eighth inch thick plexiglass panel in the channel towards the front of the frame.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A process for preparing a work of art from a sheet of transparent plastic material having an existing protective paper adhering to and covering the front and rear sides thereof comprising the steps of:

forming the mirror image of a multi-colored design to be created on the exposed surface of the protective paper on the rear side of the sheet of transparent material;

tracing a least a first portion of the design formed on the protective paper adhering to the rear side of the sheet of transparent material with a cutting tool, the said first portion being a portion of the design which is to comprise a first color, the tracing defining a continuous severed outline of said at least first portion of the design;

removing the protective paper from within the severed outline to expose at least a first part of the rear side of the sheet of transparent material;

painting the said first exposed part of the rear side of the sheet of transparent material with a paint of said first color;

tracing at least a second portion of the design formed on the protective paper adhering to the rear side of the sheet of transparent material with a cutting tool, the said second portion being a portion of the design which is to comprise a second color, the tracing defining a continuous severed outline of said at least second portion of the design;

removing the protective paper from within the severed outline of said at least second portion of the design to expose at least a second part of the rear side of the sheet of transparent material;

painting at least the said second exposed part of the rear side of the sheet of transparent material with a paint of said second color, the second color paint being applied over the first color paint at least in the abutting areas of said first and second design portions;

repeating the steps of tracing, removing and painting as required until all the colored portions of the design have been created;

removing any remaining of the protective paper from the rear side of the sheet of transparent material; and removing the protective paper adhering to the front side of the sheet of transparent material to permit viewing of the multi-color design through the transparent sheet.

2. The method of claim 1 wherein the transparent substrate comprises a plexiglass panel.

3. The method of claim 1 wherein one of the serially performed steps of removing and painting provides an integral painted mat about the periphery of the sheet of transparent material.

4. The method of claim 2 wherein one of the serially performed steps of removing and painting provides an integral painted mat about the periphery of the sheet of transparent material.

* * * * *